US011365536B1

(12) United States Patent
Omidi

(10) Patent No.: US 11,365,536 B1
(45) Date of Patent: Jun. 21, 2022

(54) EXTENDER DEVICE FOR TOILET FLUSH ACTIVATOR

(71) Applicant: Rayan Omidi, Katy, TX (US)

(72) Inventor: Rayan Omidi, Katy, TX (US)

( * ) Notice: Subject to any disclaimer, the term of this patent is extended or adjusted under 35 U.S.C. 154(b) by 0 days.

(21) Appl. No.: 17/401,047

(22) Filed: Aug. 12, 2021

(51) Int. Cl.
*E03D 5/092* (2006.01)

(52) U.S. Cl.
CPC ..... *E03D 5/092* (2013.01)

(58) Field of Classification Search
CPC E03D 5/09; E03D 5/094; E03D 5/092; E03D 5/02; E03D 5/08
USPC ..... 4/405
See application file for complete search history.

(56) References Cited

U.S. PATENT DOCUMENTS

| | | | | |
|---|---|---|---|---|
| 1,232,449 | A | 7/1917 | Mellin | |
| 1,585,557 | A | 5/1926 | Miller | |
| 1,864,827 | A | 6/1932 | Jenkins et al. | |
| 2,262,334 | A | 11/1941 | Ruggaard | |
| 2,605,479 | A | 8/1952 | Ansorge | |
| 2,862,212 | A | 12/1958 | Holl | |
| 3,419,912 | A | 1/1969 | Kertell | |
| 3,883,904 | A | 5/1975 | Wittman | |
| 4,007,499 | A | 2/1977 | Lin | |
| 4,368,551 | A | 1/1983 | Cummings | |
| 4,847,924 | A | 7/1989 | Samaniego | |
| 5,056,165 | A | 10/1991 | Wescott | |
| 5,142,708 | A | 9/1992 | Johnson et al. | |
| 5,170,513 | A | 12/1992 | Ambooken et al. | |
| 5,339,468 | A | 8/1994 | Lin | |
| 5,553,334 | A | 9/1996 | Hillman | |
| 5,599,024 | A | 2/1997 | Acuff | |
| 5,822,805 | A | 10/1998 | Lachman et al. | |
| 5,862,536 | A | 1/1999 | Huang | |
| 6,115,851 | A | 9/2000 | Maseruka | |
| 6,520,428 | B1 | 2/2003 | Elam | |
| 6,718,562 | B1 | 4/2004 | Saragas | |
| 8,726,427 | B1 | 5/2014 | Padron | |
| 9,151,031 | B1 | 10/2015 | Roby | |
| 10,385,558 | B1 * | 8/2019 | Omidi | E03D 5/09 |
| 2005/0246861 | A1 | 11/2005 | Monrad | |
| 2007/0044216 | A1 | 3/2007 | Cosby | |
| 2008/0072371 | A1 * | 3/2008 | Rogers | E03D 5/09 4/405 |
| 2011/0258765 | A1 | 10/2011 | Nguyen | |
| 2013/0269094 | A1 | 10/2013 | Pace | |
| 2016/0123028 | A1 | 5/2016 | Cunerty et al. | |

* cited by examiner

*Primary Examiner* — Lauren A Crane
(74) *Attorney, Agent, or Firm* — Brett A. Schenck

(57) ABSTRACT

An extender device for a toilet is provided. The toilet includes a flush button provided on a first surface of a tank for flushing the toilet. The extender device includes an extender button that is configured to be mounted to a front surface of the tank of the toilet, a flexible line operatively connected to the extender button, and a member operatively connected to the line. The member is configured to be in operative connection with the flush button and the extender button is configured to be pressed to thereby cause the line to move the member to cause the flush button to depress and flush the toilet.

20 Claims, 17 Drawing Sheets

EXTENDER DEVICE FOR TOILET FLUSH ACTIVATOR

FIELD

This application relates to an extender device to flush the toilets that work with flush buttons or motion sensor located on the top or side of the toilet tank. The extender is configured to be easily reached to flush the toilet by shortening the distance between the person and the flush button.

BACKGROUND

Toilets may have flush buttons or motion sensors for flushing the toilet. These flush buttons are generally located on the top or side of the tank, which is directly behind the person using the toilet. It is often difficult for people, especially the elderly, younger children, or people with disabilities to reach the flush button to flush the toilet after use. Hence, it is an objective of the present invention to make it easier for a person using the toilet to flush the toilet that has flush buttons or motions sensors on the top or side of the tank.

SUMMARY

In one aspect of the present invention, an extender device for a toilet is provided. The toilet includes a flush button provided on a first surface of a tank for flushing the toilet. The extender device includes an extender button that is configured to be mounted to a front surface of the tank of the toilet, a flexible line operatively connected to the extender button, and a member operatively connected to the line. The member is configured to be in operative connection with the flush button and the extender button is configured to be pressed to thereby cause the line to move the member to cause the flush button to depress and flush the toilet.

In another aspect of the present invention, an apparatus is provided. The apparatus includes a toilet. The toilet includes a tank. The tank includes a lid on top of the tank. The toilet further includes a bowl that is in fluid communication with the tank, and a first flush button provided on a first surface of the tank. The apparatus also includes a first extender device that includes a first extender button mounted to a front surface of the tank, a first flexible line that is operatively connected to the first extender button, and a first member that is operatively connected to the first line. The first member is in operative connection with the first flush button. Depression of the first extender button causes the first line to move the first member to cause the first flush button to depress and flush the toilet.

Other aspects of the disclosed invention will become apparent from the following detailed description, the accompanying drawings and the appended claims.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION

Figure 1A:
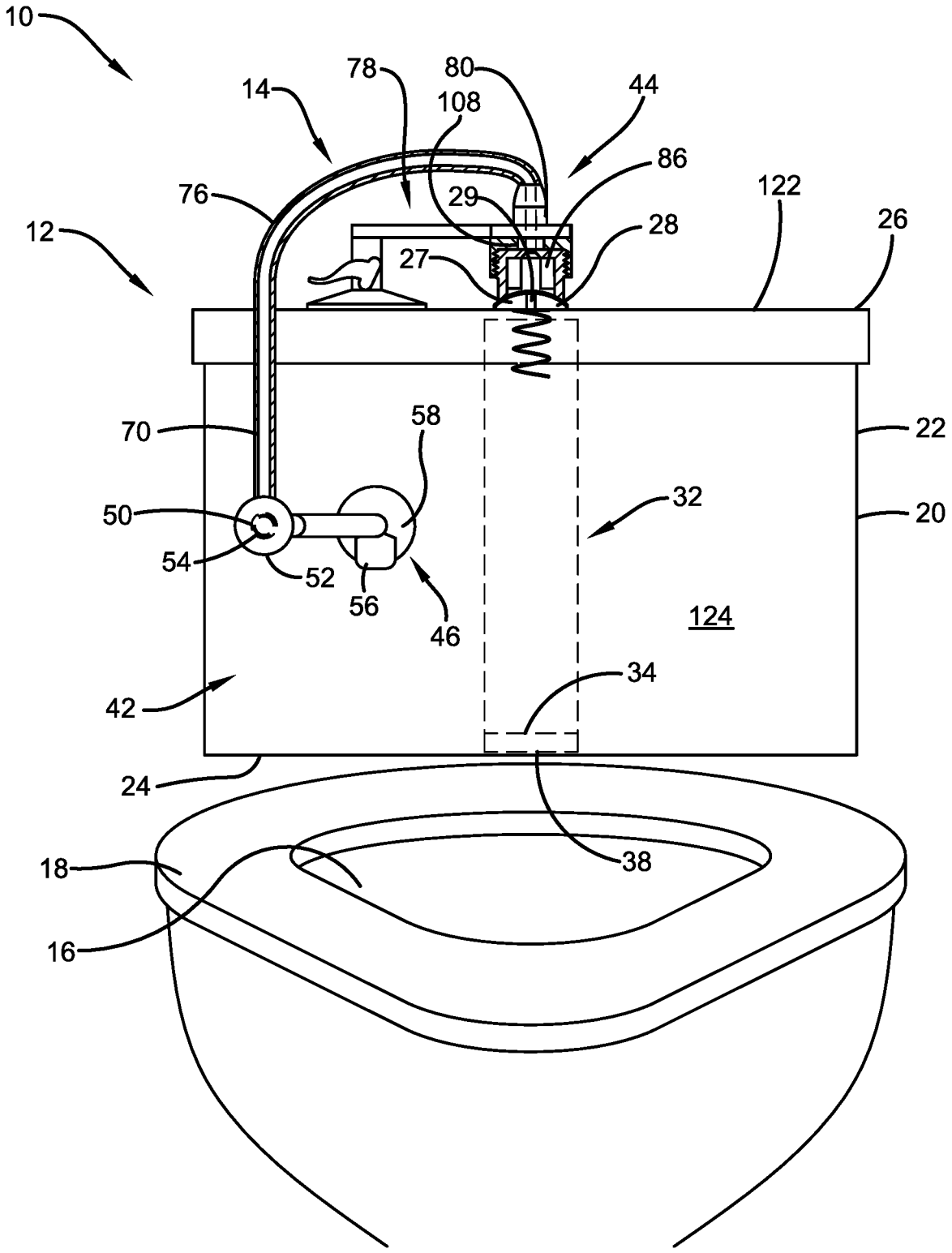
FIG. 1A is a front view of an apparatus with portions removed for illustrative purposes according to a first embodiment of the present invention.

It will be readily understood that the components of the embodiments as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

Throughout the present description, the terms "upper", "lower", "top", "bottom", "left", "right", "front", "forward", "rear", and "rearward" shall define directions or orientations with respect to the apparatus as illustrated in FIG. 1, which shows a front view of the apparatus of the present invention. It will be understood that the spatially relative terms "upper", "lower", "top", "bottom", "left", "right", "front", "forward", "rear", and "rearward" are intended to encompass different orientations of the house in use or operation in addition to the orientation depicted in the figures. For example, if the apparatus in the figures is turned over, elements described as "upper" elements or features would then be "lower" elements or features.

FIGS. 1A, 1B, 2A, and 2B show an apparatus 10 comprising a toilet 12 and an extender device 14 removably mounted on the toilet 12. The toilet 12 may comprise a toilet bowl 16, a toilet seat 18, and a toilet tank 20. The toilet seat 18 is pivotally attached at the rear end of the toilet bowl 16 and the toilet tank 20 is attached on the top of the rear end of the toilet bowl 16. The toilet tank 20 has a side wall 22, bottom wall 24 and removable lid 26 on top of the toilet tank 20. The toilet 12 is a dual-flush toilet that uses spring-loaded first and second flush push buttons 27, 28 provided on the top of the lid 26 to flush different amounts of water. A flush valve assembly 32 is provided and in operative connection with the first and second flush buttons 27, 28. The flush valve assembly 32 is configured to use less water to flush the liquid waste when the first flush button 27 is depressed, since liquid waste requires less water to be flushed than that for solid waste. Solid waste is flushed when the second flush button 28 is depressed or both of the first and second flush buttons 27, 28 are depressed. A stationary divider wall 29 is provide between the first and second flush buttons 27, 28 to separate them. Alternatively, the toilet tank 20 may have just one spring loaded flush push button for solid waste and water provided on the lid that is operatively connected to a flush valve assembly 32.

Figure 1B:
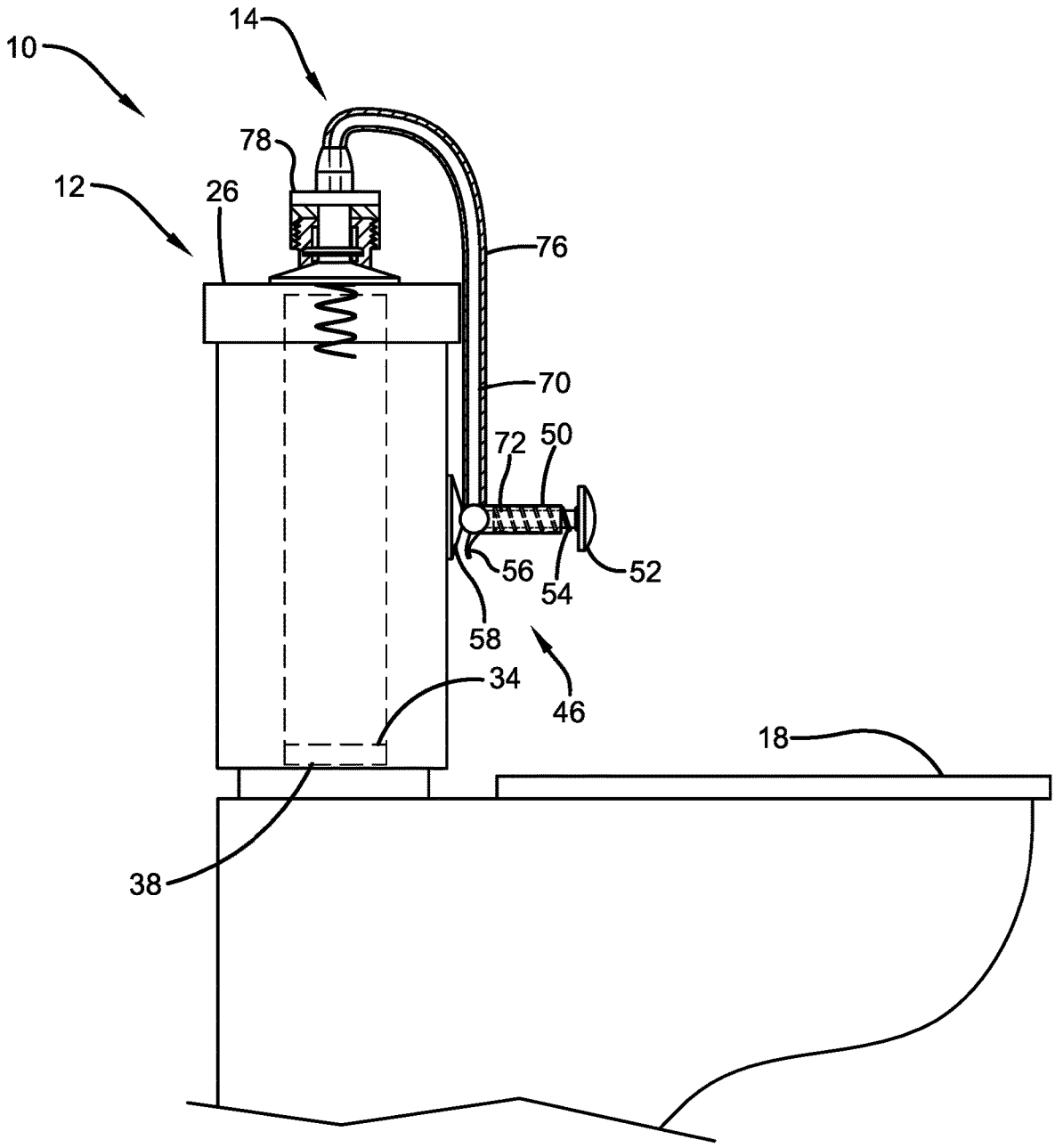
FIG. 1B is a left side view of the apparatus of FIG. 1A with portions removed for illustrative purposes.
Figure 2A:
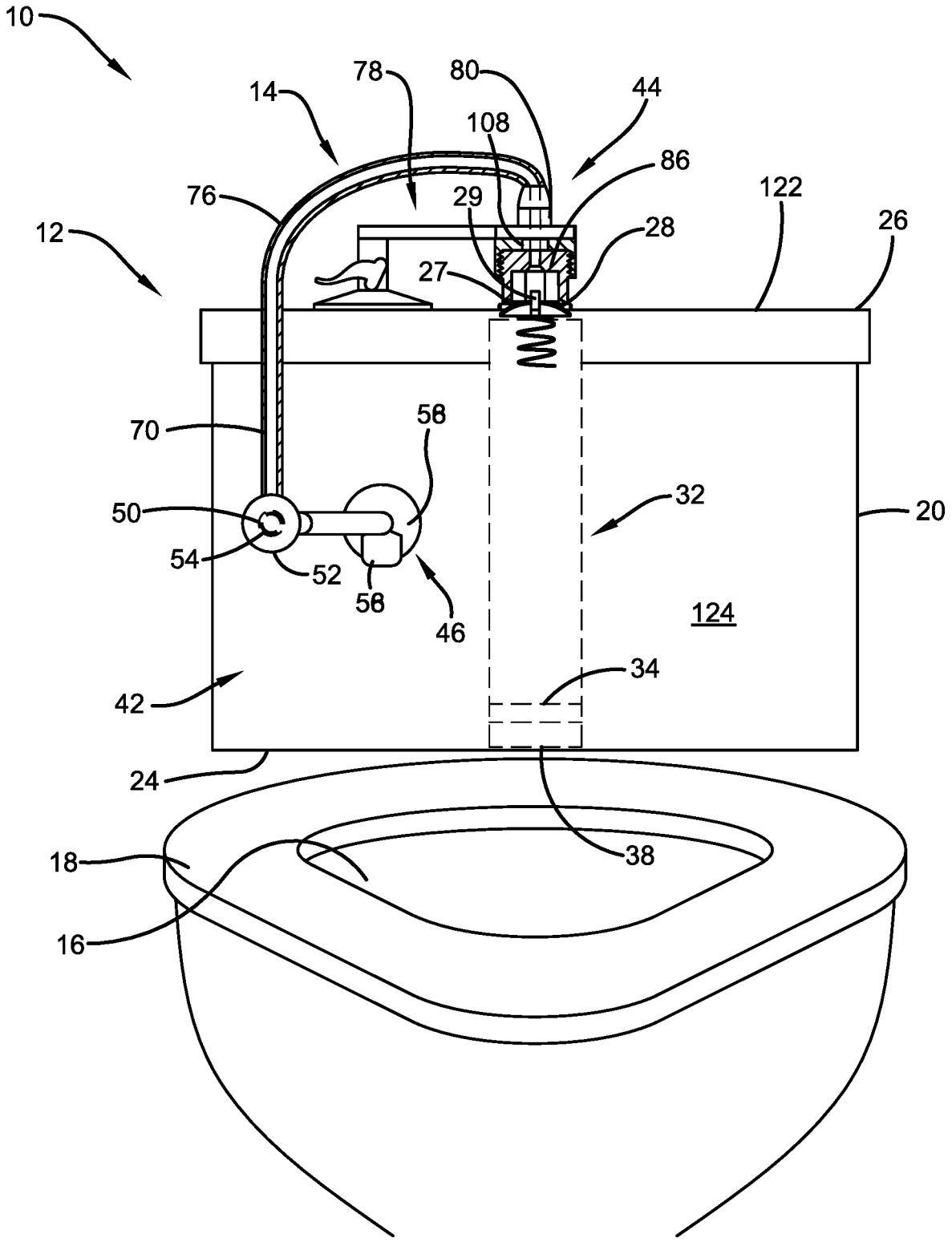
FIG. 2A is a view similar to FIG. 1A but with the apparatus in a position that flushes the toilet.
Figure 2B:
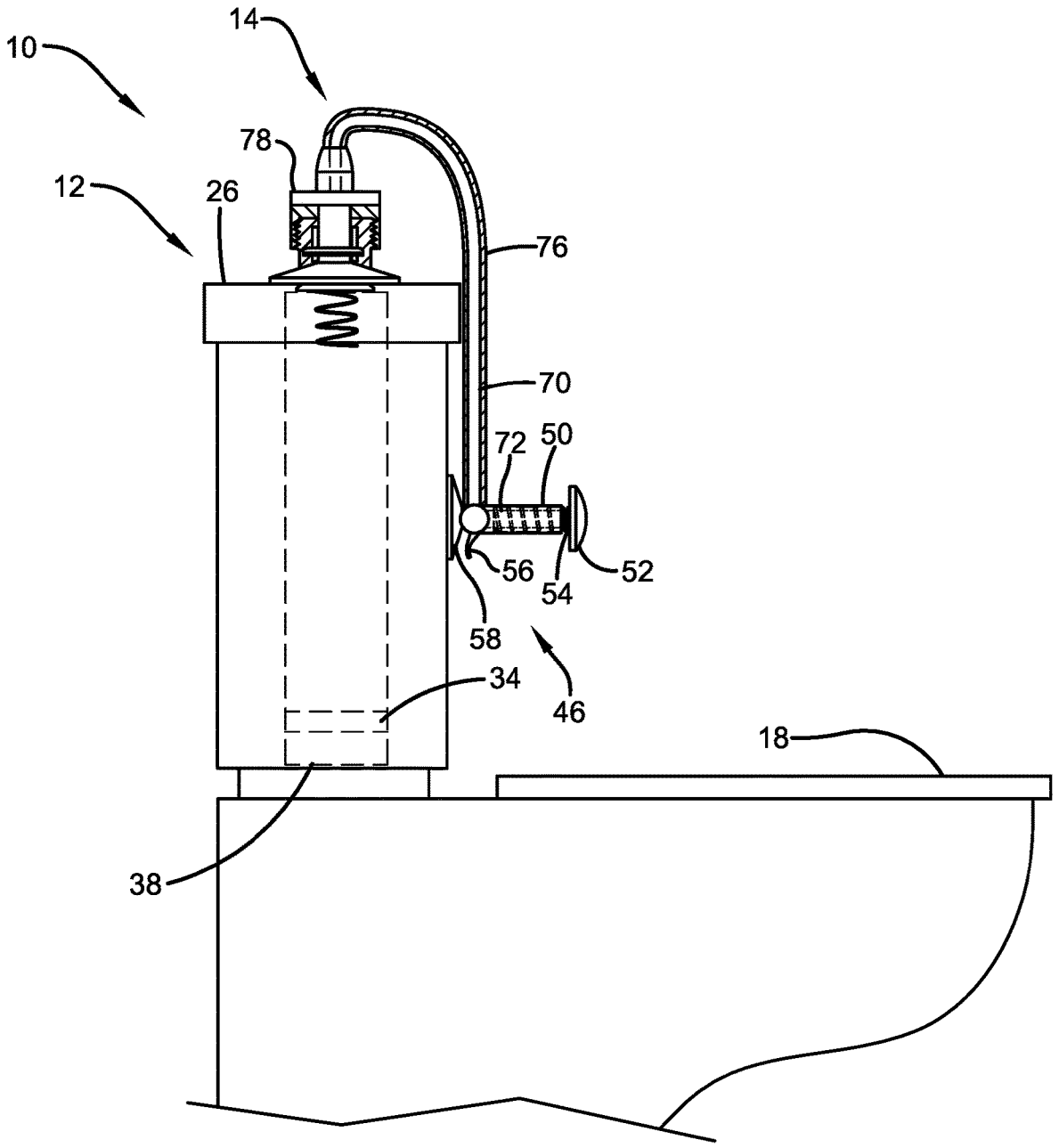
FIG. 2B is a left side view of the apparatus of FIG. 1A with portions removed for illustrated purposes.

The flush valve assembly 32 includes a valve 34 that moves up and down to open and close an outlet 38 in the bottom wall 24. When the first and second flush buttons 27, 28 are not depressed, the valve 34 closes the outlet 38 to prevent water in the toilet tank 20 from flowing out of the outlet 38 as seen in FIGS. 1A and 1B. Depression of one or both of the flush buttons 27, 28 causes the valve 34 to move upwardly away from the outlet 38 and open the outlet 38 as seen in FIGS. 2A and 2B. This allows water in the toilet tank 20 to flow into the toilet bowl 16 and flush human waste in the bowl 16 through a drainpipe (not shown) to another location for disposal. After one or both of the flush buttons 27, 28 are released, the flush button(s) are urged back upwardly by a spring 40 (FIG. 6) and thereby cause the valve 34 to move downwardly over the outlet 38 to seal and close the outlet 38. Alternatively, the spring 40 may be omitted and the flush button(s) may be urged back upwardly by the pressure of the water as it fills up the toilet tank 20.

Figure 3:
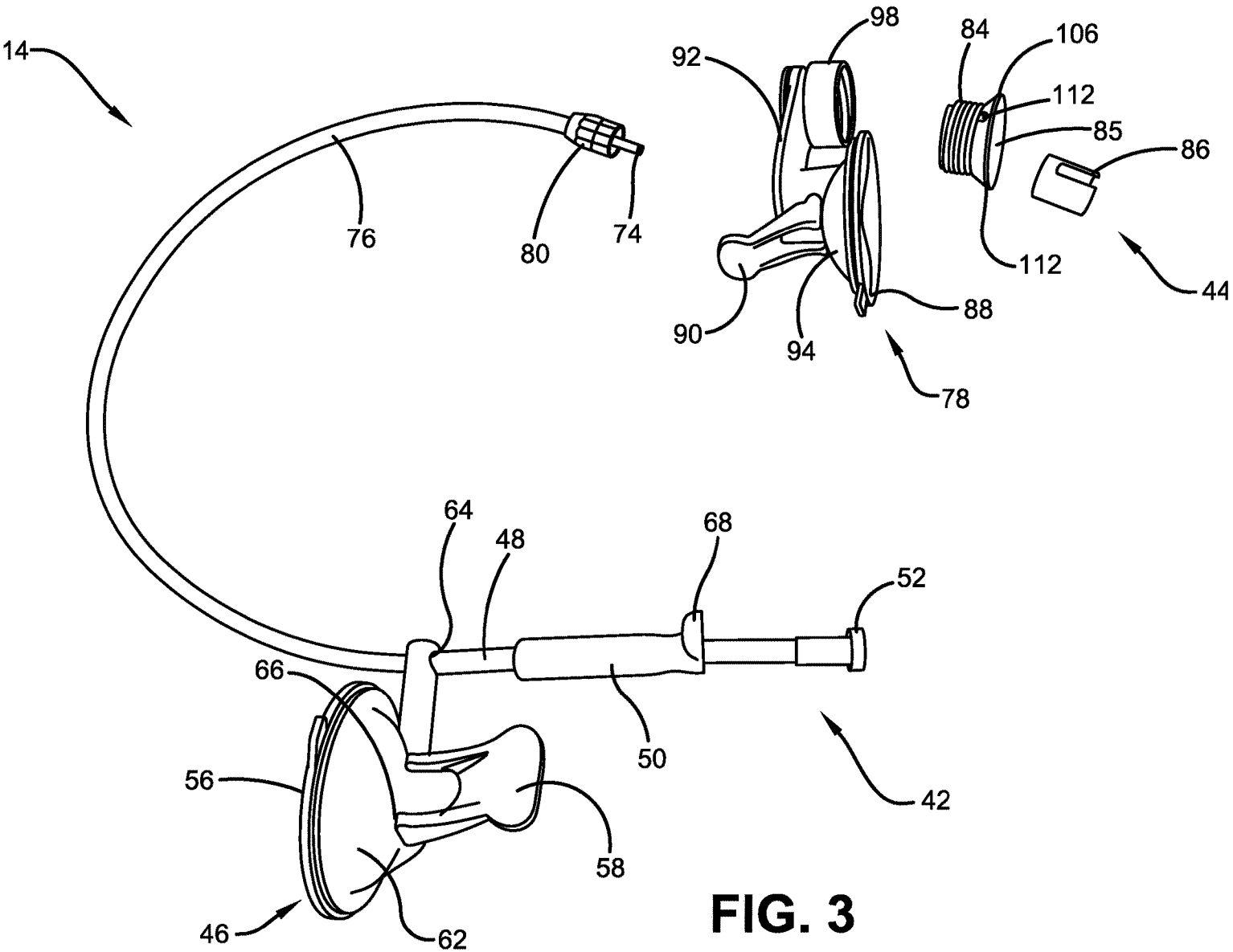
FIG. 3 is a perspective view of the extender device of the apparatus with some portions of the upper assembly being exploded.
Figure 4:
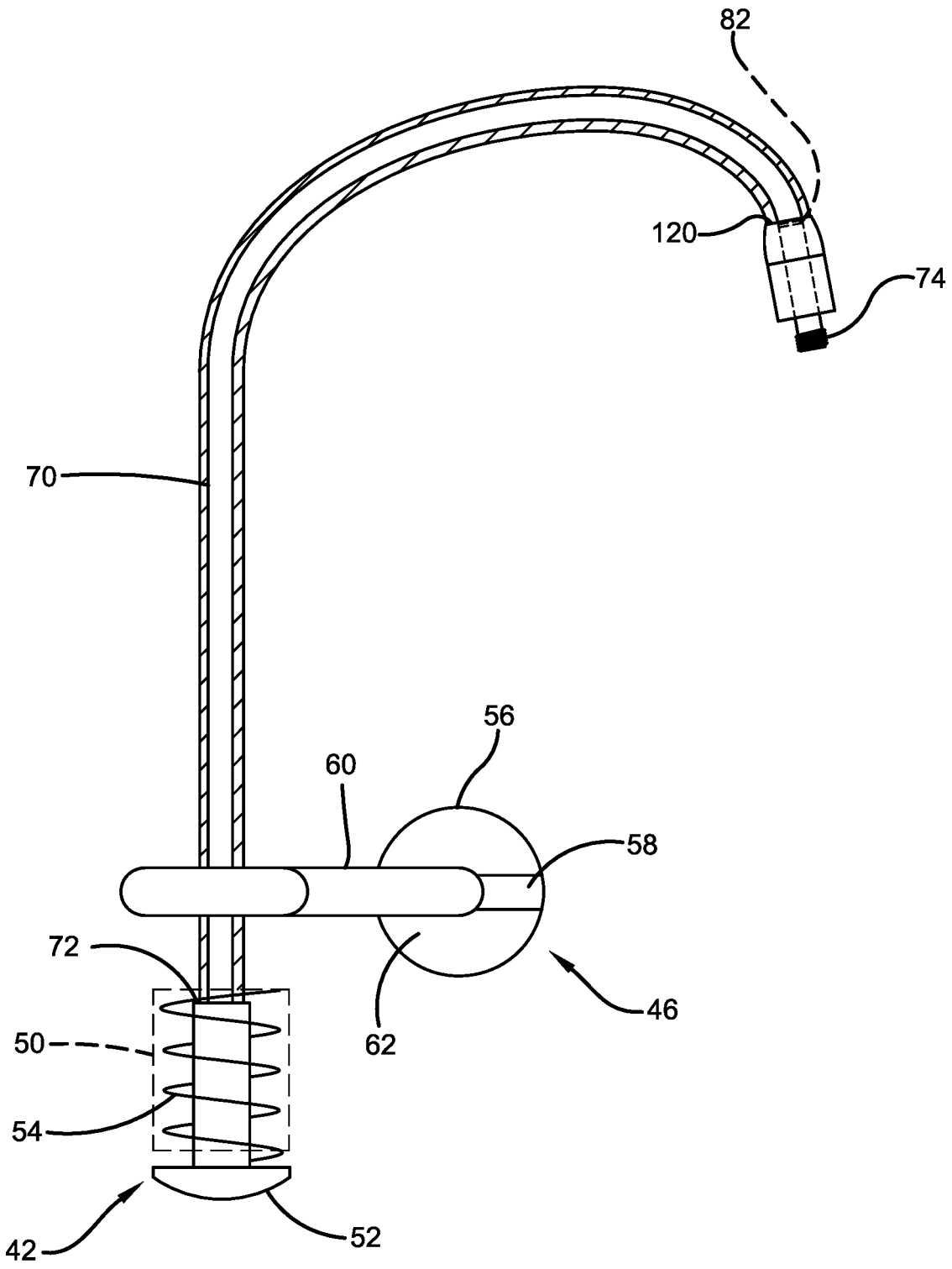
FIG. 4 is a front view of the lower assembly of the extender device of the apparatus of FIG. 1 with portions removed for illustrative purposes and with the bracket aperture, handle, coiled spring, and extender button rotated ninety degrees down for illustrative purposes.

The extender device 14 comprises a lower assembly 42 and an upper assembly 44 as illustrated in FIGS. 1A to 3. Referring to FIG. 3, The lower assembly 42 includes a lower suction cup assembly 46, a threaded male connector 48, a handle 50, an elongated extender push button 52, and a coiled spring 54 (FIGS. 1B, 2B, and 4). The lower suction cup assembly 46 includes a flexible lower suction cup 56, a lever 58, and a bracket 60. As seen in FIG. 3, the bracket 60 has a cupped end 62 that securely receives the lower suction cup 56 and another end that has a threaded aperture 64. The lever 58 is pivotally connected to the cupped end 62 with its proximal end 66 located at the center of the lower suction cup 56. When the lever 58 pivots toward the attaching surface that the lower suction cup 56 rests upon, the proximal end 66 of the lever 58 engages the outer surface (i.e., surface facing away from the attaching surface) of the lower suction cup 56 to urge the lower suction cup 56 against the attaching surface and partially collapse the lower suction cup 56 to release air inside it and create suction to secure the lower suction cup 56 to the attaching surface.

The handle 50 is elongated and hollow and has a knob 68 at its distal end. The threaded hollow male connector 48 is attached at a proximal end of the handle 50. As illustrated in FIG. 4, the coiled spring 54 is inserted into the handle 50 and positioned inside the handle 50 such that the longitudinal axes of the coiled spring 54 and handle 50 are coaxial. The extender button 52 is securely received in the coiled spring 54. A plastic or metal line 70 extends through the threaded male connector 48 and into the handle 50 and is attached to a proximal end 72 of the extender button 52. The upper end 74 of the line 70 is threaded. The coiled spring 54 urges the extender button 52 in the extended position as shown in FIG. 1B. A plastic tubular sheath 76 (FIG. 3) is attached to the threaded male connector 48 and covers the portion of the line 70 that extends between the threaded male connector 48 and the upper threaded end 74 of the line 70. The threaded male connector 48 threadily engages the threaded aperture 64 of the bracket 60 to secure the threaded male connector 48 and other parts of the lower assembly 42 to the bracket.

Figure 5:
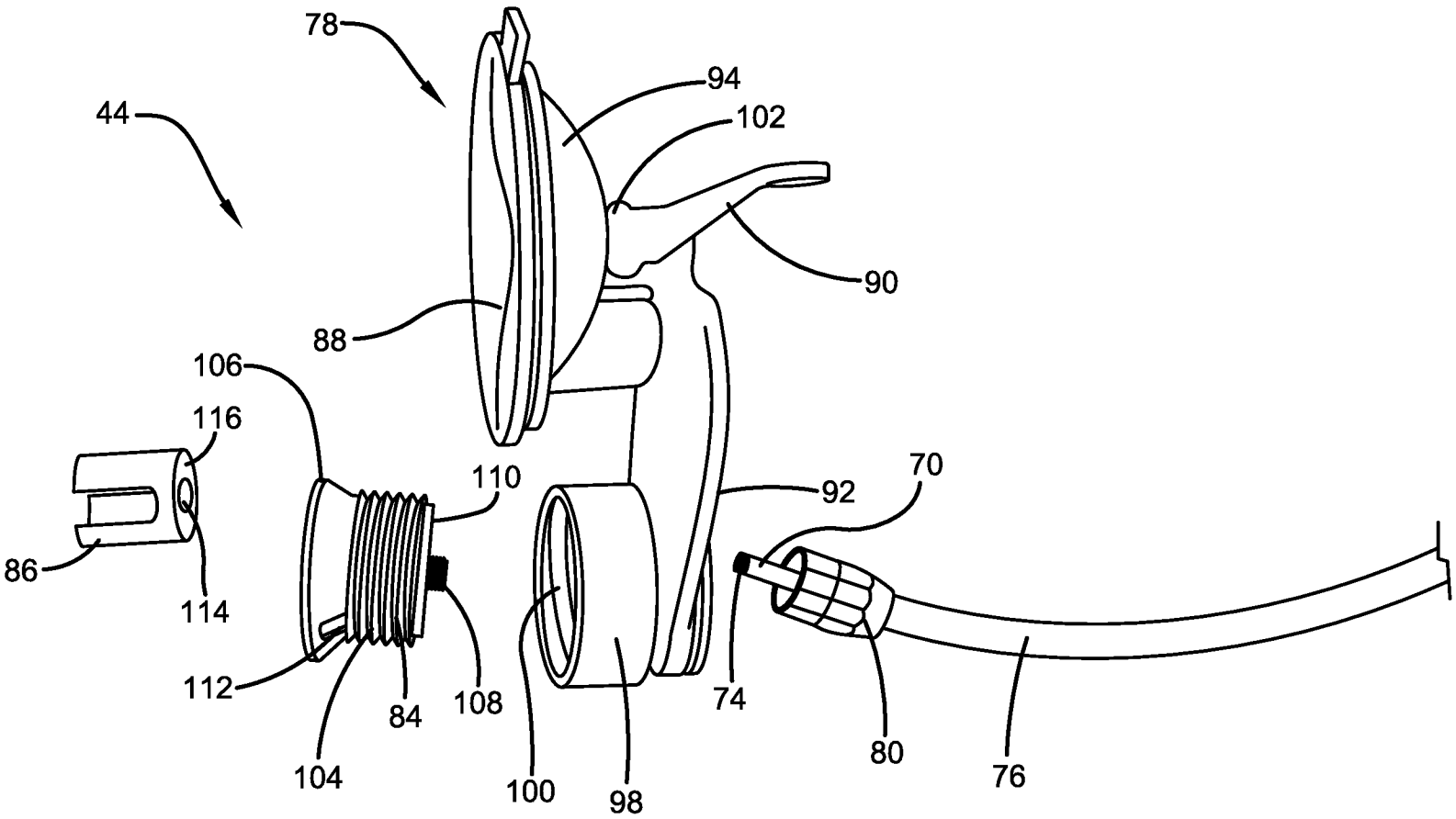
FIG. 5 is a perspective view of a portion of the apparatus of FIG. 1 showing the upper assembly of the extender device with some parts exploded.

Referring to FIGS. 1A-3, 5 and 6, the upper assembly 44 includes an upper suction cup assembly 78, a rotatable nut 80, an inner cap 84, and a knob 86. As best seen in FIGS. 3 and 5, the upper suction cup assembly 78 includes a flexible upper suction cup 88, a lever 90, and a bracket 92. The bracket 92 has a cupped end 94 that securely receives the upper suction cup 88 and another end that has an aperture 96 (FIG. 6) that securely and rotatably receives an outer cap 98. The outer cap 98 is threaded on its interior surface 100 and rotates freely relative to the bracket 92 about an axis perpendicular to the attaching surface.

The lever 90 is pivotally connected to the cupped end 94 with its proximal end 102 located at the center of the upper suction cup 88. When the lever 90 pivots toward the attaching surface that the upper suction cup 88 rests upon, the proximal end 102 of the lever 90 engages the outer surface (i.e., surface facing away from the attaching surface) of the upper suction cup 88 to urge the upper suction cup 88 against the attaching surface and partially collapse the upper suction cup 88 to release air inside it and create suction to secure the upper suction cup 88 to the attaching surface. The inner cap 84 is threaded on its outer surface 104 (FIG. 5), and its inner side 83 (FIG. 6) defines a cavity 85 (FIG. 3). The inner cap 84 also has a flange 106 on its lower end and a threaded hollow bolt 108 attached at the center of the top portion 110 of the inner cap 84. The bolt 108 is threaded on its exterior surface. The flange 106 has two oppositely located slots 112 (FIG. 3). The knob 86 has a generally inverted u-shaped configuration to provide space for the divider wall 29 the pass through and not interfere with knob 86 when the knob 86 is moving downward as it pushes the first and second flush buttons 27, 28. A threaded knob aperture 114 (FIG. 5) is formed at the center of the top or bight portion 116 of the knob 86.

Figure 12:
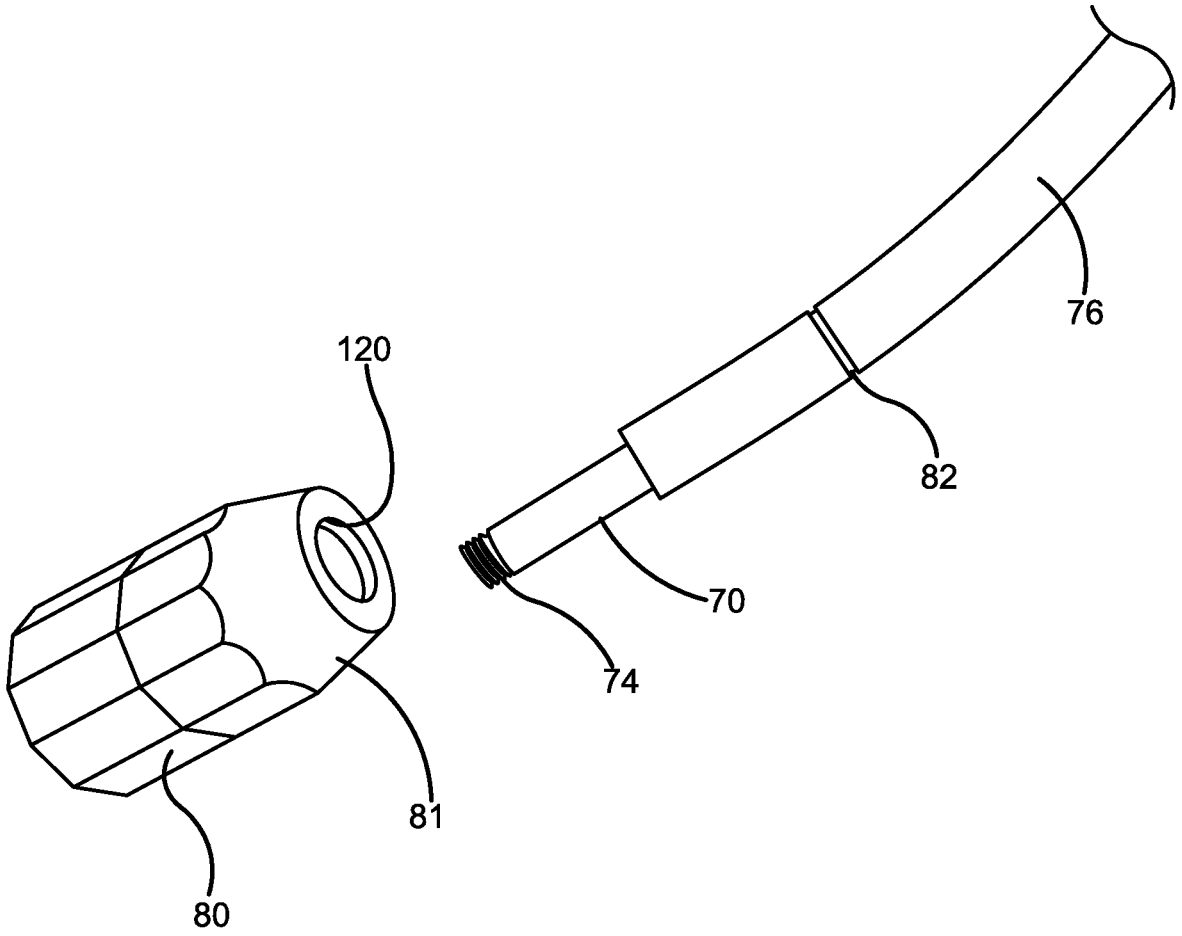
FIG. 12 is a perspective view of a portion of the apparatus of FIG. 1 with some parts exploded showing the rotatable nut and a portion of the line and tubular sheath.

As illustrated in FIG. 12, the sheath 76 has an annular groove 82 that extends circumferentially around the sheath 76 and is located near the upper threaded end 74 of the line 70. The rotatable nut 80 slidingly receives the sheath 76 at the groove 82 and freely rotates relative to the sheath 76. In particular, the nut has a tapered upper axial end 81 in which the edge of the nut 80 at the upper axial end 81 of the nut 80 extends radially inward to define an annular flange 120. The flange 120 defines an aperture that has a diameter that is slightly smaller than the outer diameter of the tubular sheath 76 except at the groove 82. The flange 120 seats into the groove 82 and is engaged by the groove 82 to prevent the rotatable nut 80 from sliding along the sheath 76 as illustrated in FIG. 4.

Figure 6:
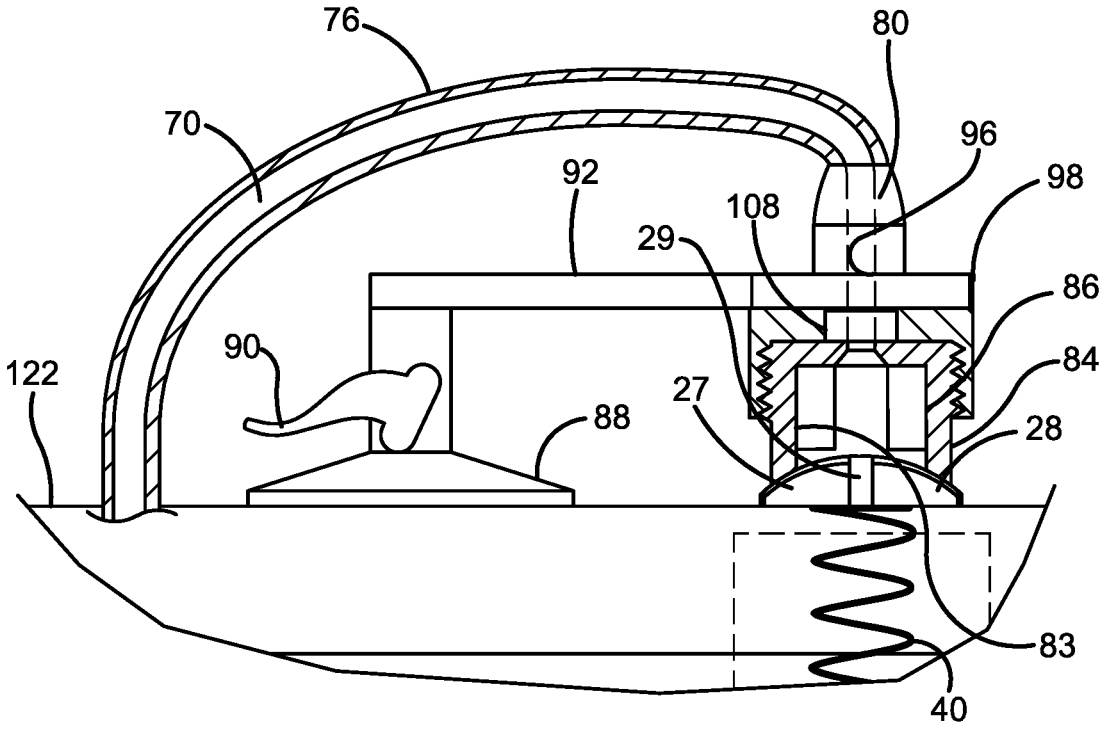
FIG. 6 is a front view of the upper assembly of the extender device and related parts of the apparatus of FIG. 1 with portions removed for illustrative purposes.

As illustrated in FIG. 6, the line 70 extends through the rotatable nut 80, the aperture 96 of the bracket 92, the outer cap 98 and the threaded hollow bolt 108 of the inner cap 84. The threaded end 74 of the line 70 is threaded into the knob aperture 114 to threadily connect the knob 86 to the line 70 at the knob aperture 114. The knob 86 is sized to slidably fit into the cavity 85 (FIG. 3) of the inner cap 84. The rotatable nut 80 extends through the aperture 96 of the bracket 92 and the outer cap 98. The nut 80 threadily engages the threaded hollow bolt 108 to secure the inner cap 84 to the line 70. The outer cap 98 threadily engages the outer surface 100 of the inner cap 84 to secure the upper suction cup assembly 78 to the line 70 to hold the upper assembly 44 in the desired position.

FIGS. 1A to 2B show the toilet extender 14 assembled to the toilet 12. When the toilet extender 14 is assembled to the toilet 12 in its extended position as shown in FIGS. 1A and 1B, the knob 86 is aligned over the flush buttons 27, 28 and contacts the flush buttons 27, 28 or is in close proximity to the flush buttons 27, 28. The upper suction cup 88 is positioned flushed on the top surface 122 of the lid 26 of the tank 20 and attached to the lid 26 of the tank 20 by rotating the lever 90 towards the lid 26. The extender button 52 is positioned at a desired location such as at the front of the tank 20. The lower suction cup 56 is placed flushed on the front surface 124 of the tank 20 and attached to the front surface 124 of the tank 20 by rotating the lever 58 towards the front surface 124 of the tank 20. As illustrated in the FIGS. 1A and 1B, the combination of the elongated handle 50, the male connector 48, and elongated extender button 52 position the extender button 52 close to a user sitting on the toilet 12 to enable the user to easily reach and grasp the handle 52 and operate the extender button 52 without the user turning around.

Figure 13:
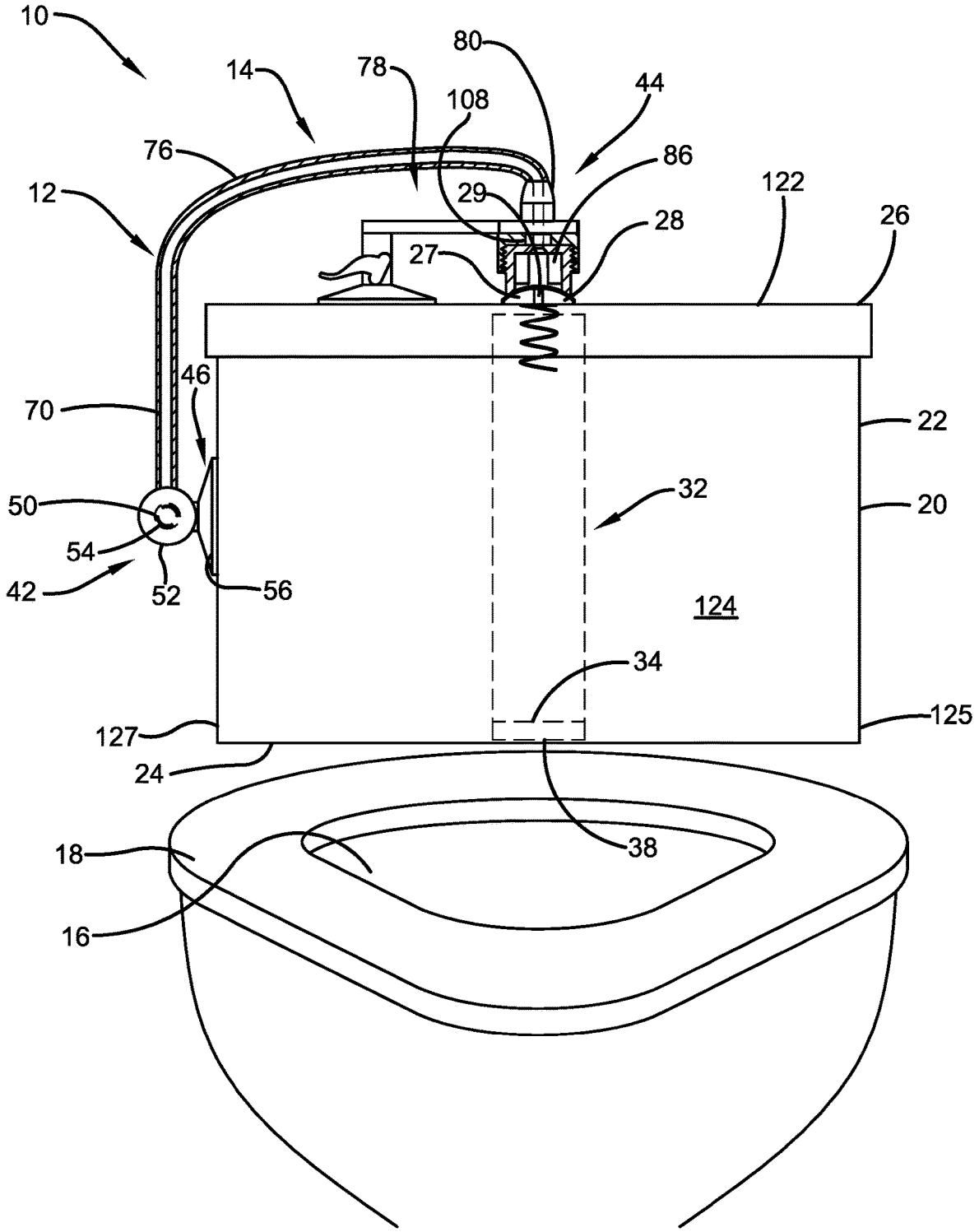
FIG. 13 is a front view of the apparatus of FIG. 1A that is similar to that of FIG. 1A except that the lower suction cup is placed on the left side surface of the toilet tank.
Figure 14:
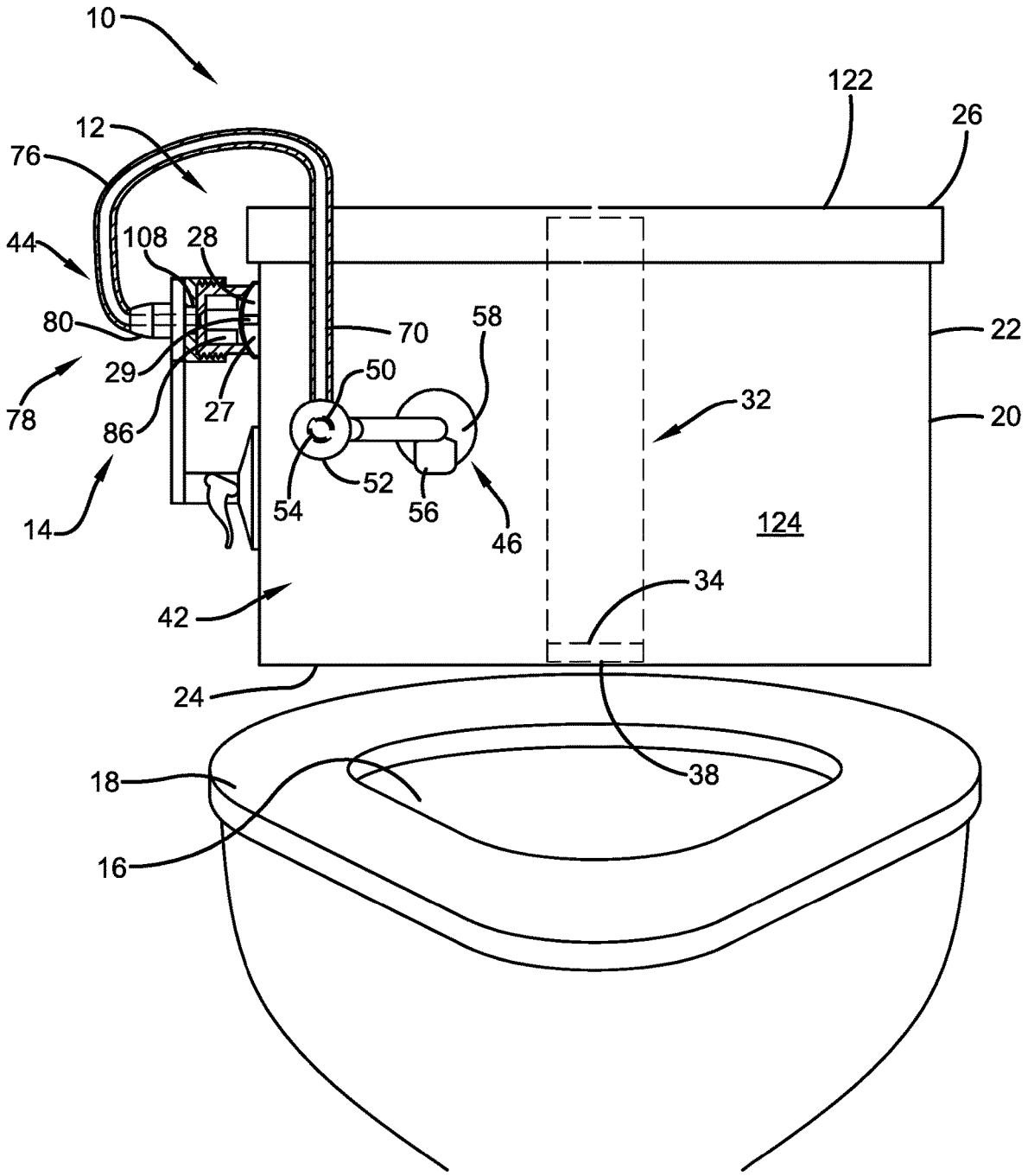
FIG. 14 is a front view of the apparatus of FIG. 1A that is similar to that of FIG. 1A except that the upper suction cup is placed on the left side surface of the toilet tank for depressing flush buttons provided on the left side of the toilet tank.
Figure 15:
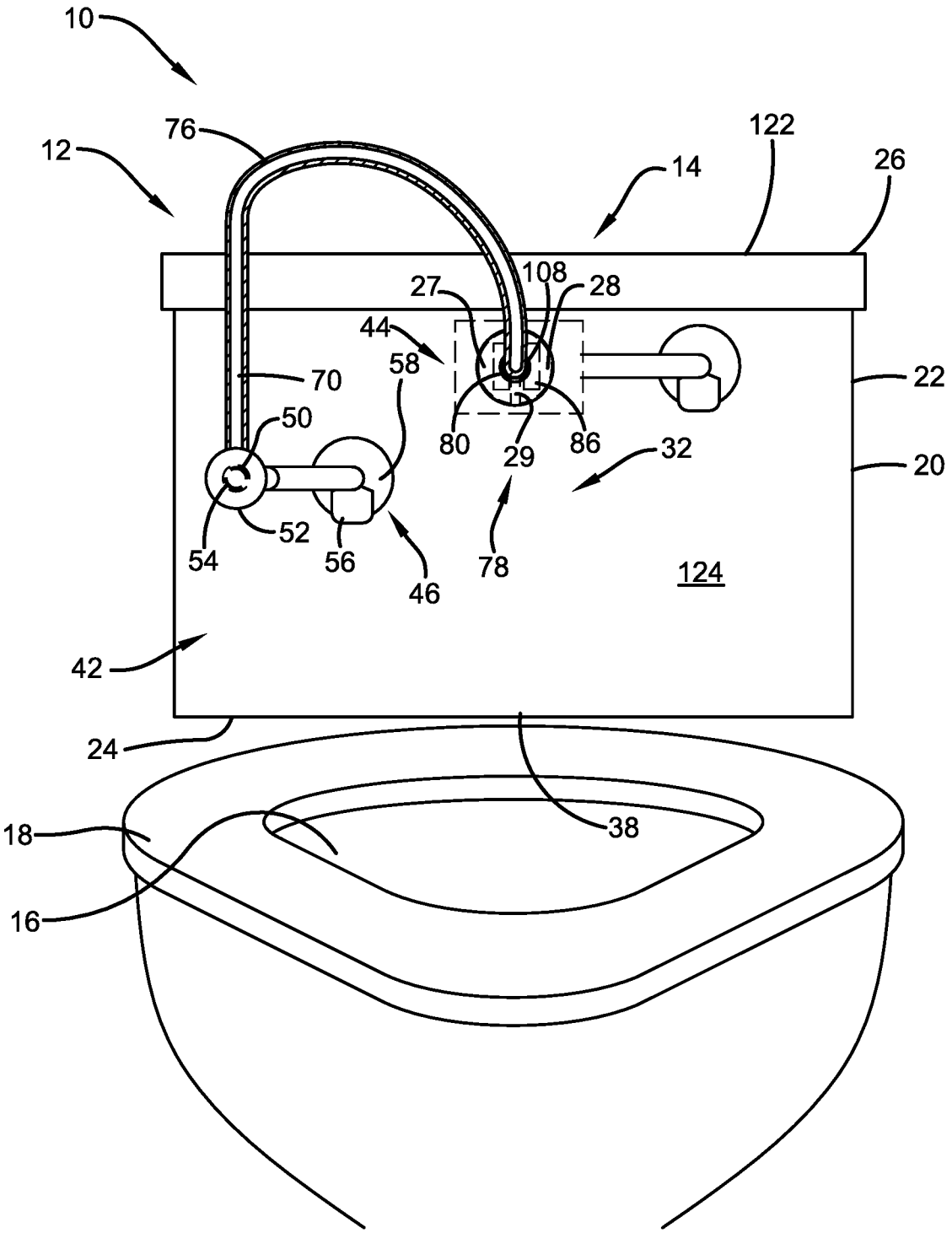
FIG. 15 is a front view of the apparatus of FIG. 1A that is similar to that of FIG. 1A except that the upper suction cup is placed on the front surface of the toilet tank for depressing flush buttons provided on the front side of the toilet tank.

The toilet extender 14 can be installed on other locations of the toilet 12 as desired. For example, the lower assembly 42 may be configured such that the extender button 52 is positioned at the front of the tank 20 and the lower suction cup 56 may be placed on a left side surface 127 of the tank 20 as illustrated in FIG. 13, or a right side surface 125. Alternatively, the upper assembly 44 may be configured such that the upper suction cup 88 is placed on the left side surface 127 of the toilet tank 20 for depressing flush buttons 27, 28 provided on the left side of the toilet tank 20 as shown in FIG. 14. Alternatively, the upper assembly 44 may be configured such that the upper suction cup 88 is placed on the front surface 124 of the toilet tank 20 for depressing the flush buttons 27, 28 provided on the front side of the toilet tank 20 as shown in FIG. 15. Alternatively, the lower assembly 42 may be configured such that the bracket aperture 64, handle 50, coiled spring 54, and extender button 52 are rotated ninety degrees down as illustrated in FIG. 4.

In operation, a user grasps the handle 50 and pushes the extender button 52 with sufficient force to overcome the biasing forces of the springs 40, 54 to move the line 70 through the handle 50, the male connector 48, the sheath 76, the rotatable nut 80, and the threaded hollow bolt 108 of the inner cap 84. This movement of the line 70 in turn moves the knob 86 against the first and second flush buttons 27, 28 to depress the flush buttons 27, 28. Depression of the flush buttons 27, 28 causes the valve 34 to move upwardly away from the outlet 38 and open the outlet 38 as seen in FIGS. 2A and 2B. This allows water in the toilet tank 20 to flow into the toilet bowl 16 and flush human waste in the bowl through a drainpipe (not shown) to another location for disposal. Release of the force pushing the extender button 52 causes the coiled spring 54 to urge the extender button 52 back to its initial extended position and move the knob 86 upwardly a sufficient distance to release the pushing force on the flush buttons 27, 28. After the pushing force on the flush buttons 27, 28 is released, the flush buttons 27, 28 are urged back upwardly to their initial extended position by the spring 40. Alternatively, the spring 40 may be omitted and the flush buttons 27, 28 may be urged back upwardly by the pressure of the water as it fills up the toilet tank 20.

This action causes the valve 34 to move downwardly over the outlet 38 and seal and close the outlet 38. Since the knob 86 is sized to be slidably fit into the inner cap 84 (as illustrated in FIG. 6), the inner cap 84 can guide the movement of the knob 86 to be aligned over the flush buttons 27, 28.

Figure 7:
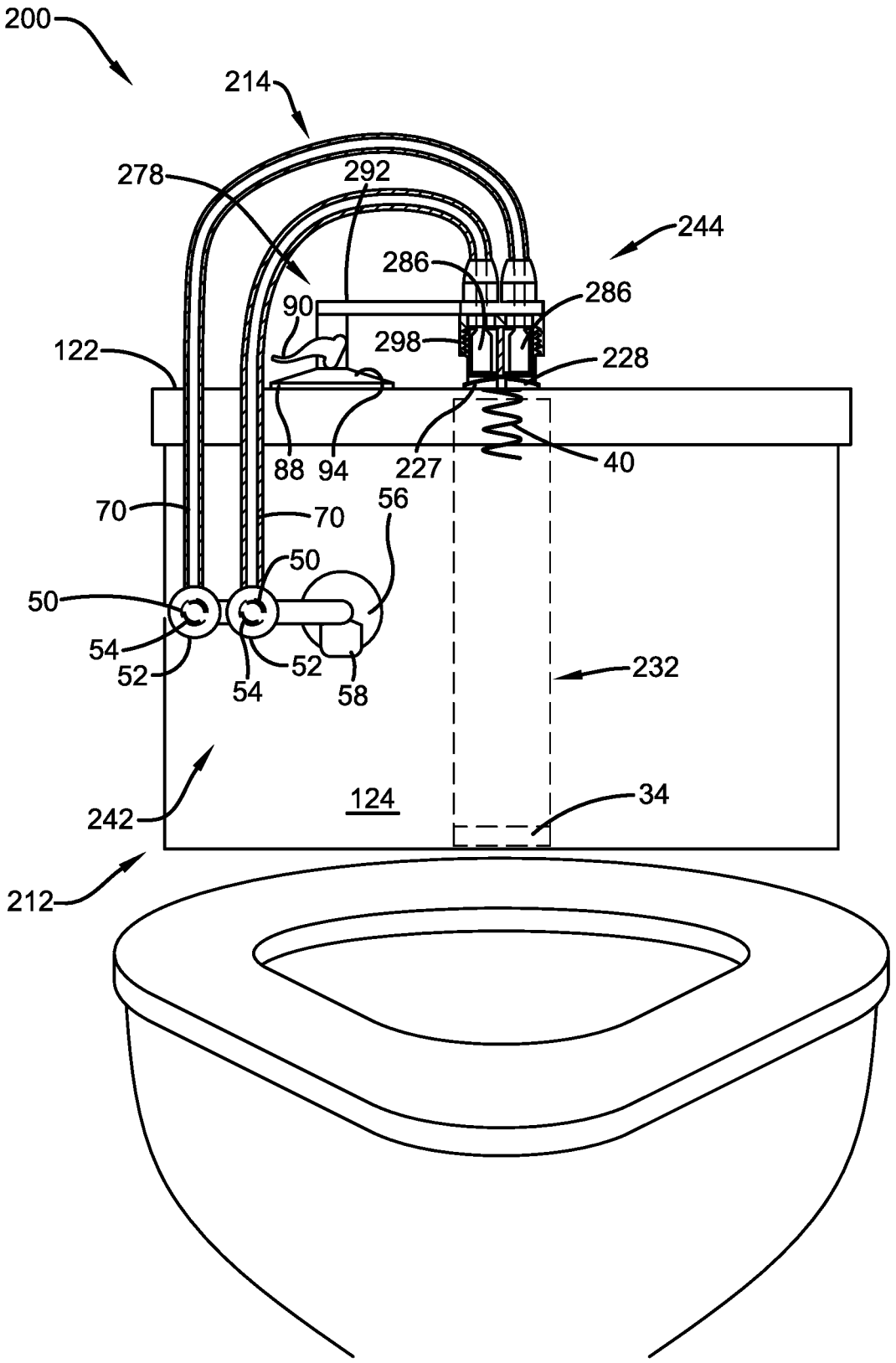
FIG. 7 is a front view of an apparatus with portions removed for illustrative purposes according to a second embodiment of the present invention.
Figure 8:
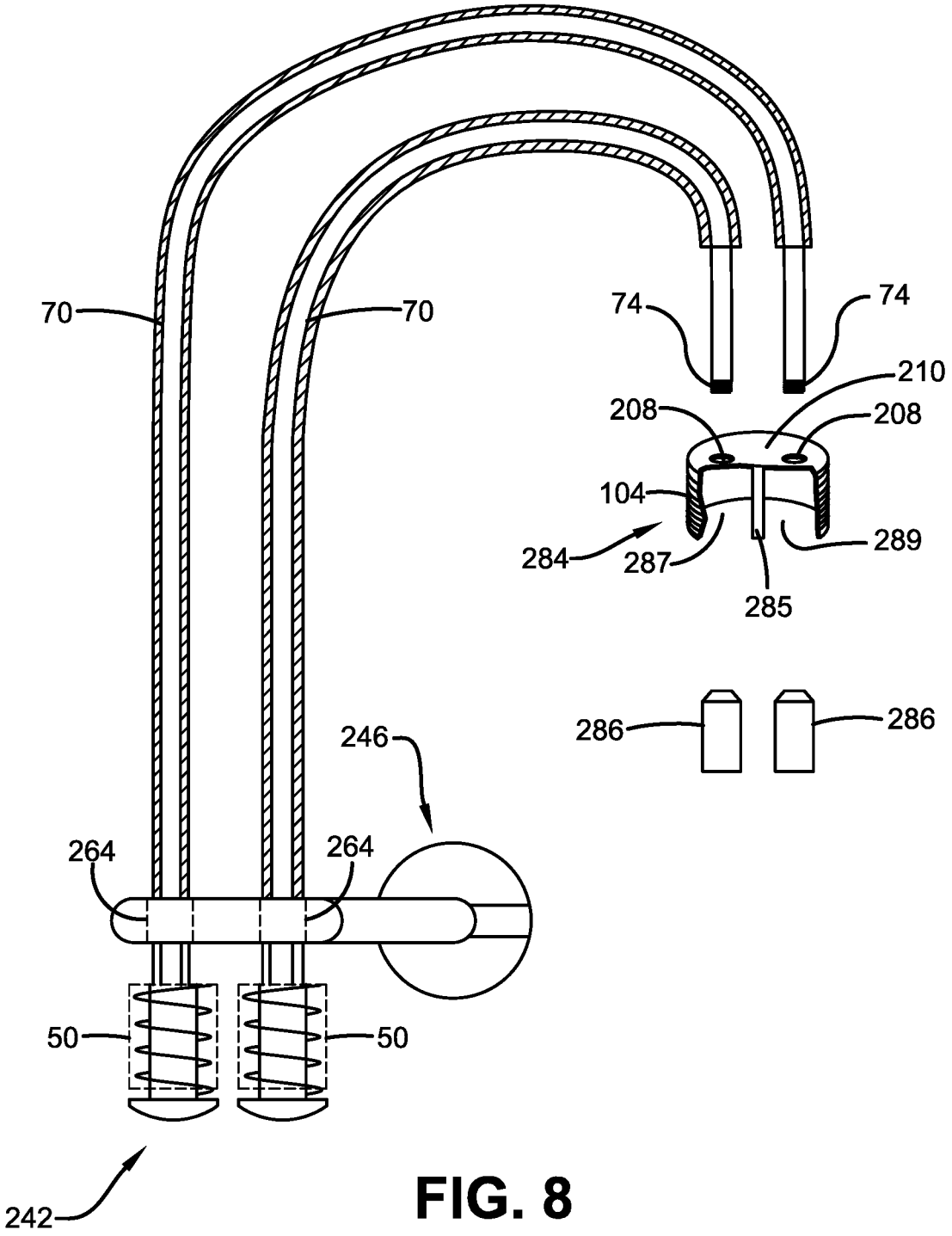
FIG. 8 is a front view of a portion of the apparatus of FIG. 7 with some parts exploded and removed for illustrative purposes and with the bracket apertures, handles, coiled springs, and extender buttons rotated ninety degrees down for illustrative purposes.

FIGS. 7 and 8 show a second embodiment of the present invention. The second embodiment is similar to the first embodiment except for the following. Thus, in this second embodiment, elements that are similar in structure and function with the first embodiment will be given the same reference numbers. In this second embodiment, an apparatus 200 comprising a toilet 212 and an extender device 214 removably mounted on the toilet 212 is provided. The toilet 212 is a dual-flush toilet that uses first and second flush buttons 227, 228 to flush different amounts of water. A flush valve assembly 232 is provided and in operative connection with the first and second flush buttons 227, 228. The flush valve assembly 232 is configured to use less water to flush the liquid waste when the first flush button 227 is depressed, since liquid waste requires less water to be flushed than that for solid waste. Thus, depression of the first flush button 227 activates the flush valve assembly 232 to cause an amount of water that is sufficient to flush liquid waste and depression of the second flush button 228 activates the flush valve assembly 232 to cause a larger quantity of water that is sufficient to flush solid waste.

The extender device 214 has first and second extender buttons 52 that actuate their respective first and second flush buttons 227, 228. In particular, the extender device 214 comprises a lower assembly 242 and an upper assembly 244. The lower assembly 242 includes a lower suction cup assembly 246, first and second threaded male connectors 48, first and second handles 50, the first and second extender buttons 52, and first and second coiled springs 54. The lower suction cup assembly 246 includes a flexible lower suction cup 56, a lever 58, and a bracket 260. The bracket 260 has a cupped end 62 that securely receives the lower suction cup 56 and another end that has first and second threaded apertures 264 (FIG. 8). The lever 58 is pivotally connected to the cupped end 62 with its proximal end 66 located at the center of the lower suction cup 56. When the lever 58 pivots toward the attaching surface that the lower suction cup 56 rests upon, the proximal end 66 of the lever 58 engages the outer surface (i.e., surface facing away from the attaching surface) of the lower suction cup 56 to urge the lower suction cup 56 against the attaching surface and partially collapse the lower suction cup 56 to release air inside it and create suction to secure the lower suction cup 56 to the attaching surface.

Each of the first and second handles 50 is elongated and hollow and has a knob 68 at its distal end. Each of the first and second threaded hollow male connectors 48 is attached at a proximal end of its associated handle 50. As illustrated in FIG. 8, each of the first and second coiled springs 54 is inserted into its respective handle 50 and positioned inside the handle 50 such that the longitudinal axes of the coiled spring 54 and the handle 50 are coaxial. Each of the first and second extender buttons 52 is securely received in its respective coiled spring 54. A first plastic or metal line 70 extends through the first threaded male connector 48 and into the first handle 50 and is attached to a proximal end 72 of the first extender button 52. The upper end 74 of the first line 70 is threaded. The first coiled spring 54 urges the first extender button 52 in the extended position as shown in FIG. 7. A first plastic tubular sheath 76 is attached to the first threaded male connector 48 and covers the portion of the first line 70 that extends between the first threaded male connector 48 and the upper end 74 of the first line 70. The first threaded male connector 48 threadily engages the first threaded aperture 264 of the bracket 260 to secure the first threaded male connector 48 and other parts of the lower assembly 42 to the bracket 260.

A second plastic or metal line 70 extends through the second threaded male connector 48 and into the second handle 50 and is attached to a proximal end 72 of the second extender button 52. The upper end 74 of the second line 70 is threaded. The second coiled spring 54 urges the second extender button 52 in the extended position as shown in FIG. 7. A second plastic tubular sheath 76 is attached to the second threaded male connector 48 and covers the portion of the second line 70 that extends between the second threaded male connector 48 and the upper end 74 of the second line 70. The second threaded male connector 48 threadily engages the second threaded aperture 264 of the bracket 260 to secure the second threaded male connector 48 other parts of the lower assembly 42 to the bracket 260.

The upper assembly 244 includes an upper suction cup assembly 278, first and second rotatable nuts 80, an inner cap 284, and first and second knobs 286. The upper suction cup assembly 278 includes a flexible upper suction cup 88, a lever 90, and a bracket 292. The bracket 292 has a cupped end 94 that securely receives the upper suction cup 88 and another end that has an aperture that securely and rotatably receives an outer cap 298. The outer cap 298 is threaded on its interior surface 100 and rotates freely relative to the bracket 292 about an axis perpendicular to the attaching surface.

The lever 90 is pivotally connected to the cupped end 94 with its proximal end 102 located at the center of the upper suction cup 88. When the lever 90 pivots toward the attaching surface that the upper suction cup 88 rests upon, the proximal end 102 of the lever 90 engages the outer surface (i.e., surface facing away from the attaching surface) of the upper suction cup 88 to urge the upper suction cup 88 against the attaching surface and partially collapse the upper suction cup 88 to release air inside it and create suction to secure the upper suction cup 88 to the attaching surface. The inner cap 284 is threaded on its outer surface 104. The inner cap 284 also has a dividing wall 285 that divides the interior of the inner cap 284 into first and second cavities 287, 289. The inner cap 284 also has first and second threaded hollow bolts 208 attached at the top portion 210 of the inner cap 284.

Each of the first and second rotatable nuts 80 slidingly receives its respective sheath 76 and line 70 and freely rotates relative to the sheath 76. Similar to the first embodiment, each of the first and second nuts 80 includes a flange 120 that seats into the groove 82 of its respective sheath 76 and is engaged by the groove 82 to prevent the rotatable nut 80 from sliding along the sheath 76. Each of the first and second lines 70 extends through its respective rotatable nut 80, aperture 296 of the bracket 292, the outer cap 298 and its respective threaded hollow bolt 208 of the inner cap 284. The threaded end 74 of each line 70 is threaded into the knob aperture 114 of its respective knob 286 to threadily connect the knob 286 to the line 70 at the knob aperture 114. The first knob 286 is sized to be slidably fit into the first cavity 287 of the inner cap 284, and the second knob 286 is sized to slidably fit into the second cavity 289 of the inner cap 284. Each nut 80 extends through the aperture of the bracket 292 and the outer cap 298 and threadily engages its respective threaded hollow bolt 208 to secure the inner cap 284 to the line 70. The outer cap 298 threadily engages the outer surface 104 of the inner cap 284 to secure the upper suction cup assembly 278 to the line 70 to hold the upper assembly 244 in the desired position.

FIG. 7 shows the toilet extender 214 assembled to the toilet 212. When the toilet extender 214 is assembled to the toilet 212 in its extended position as shown in FIG. 7, the first and second knobs 286 are aligned over their respective first and second flush buttons 227, 228 and contact their respective flush buttons 227, 228 or are in close proximity to their flush buttons 227, 228. The upper suction cup 88 is positioned flushed on the top surface 122 of the lid 26 of the tank 20 and attached to the lid 26 of the tank 20 by rotating the lever 90 towards the lid 26. The extender buttons 52 are positioned at a desired location such as at the front of the tank 20. The lower suction cup 56 is placed flushed on the front surface 124 of the tank 20 and attached to the front surface 124 of the tank 20 by rotating the lever 58 towards the front surface 124 of the tank 20. Alternatively, the lower assembly 242 may be configured such that the extender button 52 is positioned at a desired location such as at the front of the tank 20 and the lower suction cup 56 may be placed on the right or left side surface 125, 127 of the tank 20.

If the user desires to flush solid waste or otherwise flush the toilet 212 using the second flush button 228, the user grasps the second handle 50 and pushes the second extender button 52 with sufficient force to overcome the biasing forces of the springs 40, 54 to move the second line 70 through the second handle 50, the second male connector 48, the second sheath 76, the second nut 80, and the second threaded hollow bolt 208 of the inner cap 284. This movement of the second line 70 in turn moves the second knob 286 against the second flush button 228 to depress the second flush button 228. Depression of the second flush button 228 causes the valve 34 to move upwardly away from the outlet 38 and open the outlet 38 as seen in FIG. 2. This allows sufficient water in the toilet tank 20 to flow into the toilet bowl 16 and flush solid waste in the bowl through a drainpipe (not shown) to another location for disposal. Release of the force pushing the second extender button 52 causes the second coiled spring 54 to urge the second extender button 52 back to its initial extended position and move the second knob 286 upwardly a sufficient distance to release the pushing force on the second flush button 228. After the pushing force on the second flush button 228 is released, the second flush button 228 is urged back upwardly to its initial extended position by the spring 40. Alternatively, the spring 40 may be omitted and the second flush button 228 may be urged back upwardly by the pressure of the water as it fills up the toilet tank 20.

This action causes the valve 34 to move downwardly over the outlet 38 and seal and close the outlet 38. Since the second knob 286 is sized to be slidably fit into the second cavity 289 of the inner cap 284, the inner cap 284 can guide the movement of the knob 86 to be aligned over the second flush button 228.

If the user desires to flush just liquid waste or otherwise flush the toilet 212 using the first flush button 227, the user grasps the first handle 50 and pushes the first extender button 52 with sufficient force to overcome the biasing forces of the springs 40, 54 to move the first line 70 through the first handle 50, the first male connector 48, the first sheath 76, the first nut 80, and the first threaded hollow bolt 208 of the inner cap 284. This movement of the first line 70 in turn moves the first knob 286 against the first flush button 227 to depress the flush first button 227. Depression of the first flush button 227 causes the valve 34 to move upwardly away from the outlet 38 and open the outlet 38 similar to that when the second flush button 228 is depressed except that less water is used to flush the liquid waste since liquid waste requires less water to be flushed than that for solid waste.

This action allows a sufficient amount of water in the toilet tank 20 to flow into the toilet bowl 16 and flush liquid waste in the bowl through a drainpipe (not shown) to another location for disposal. Release of the force pushing the first extender button 52 causes the first coiled spring 54 to urge the first extender button 52 back to its initial extended position and move the first knob 286 upwardly a sufficient distance to release the pushing force on the first flush button 227. After the pushing force on the first flush button 227 is released, the first flush button 227 is urged back upwardly to its initial extended position by the spring 40. Alternatively, the spring 40 may be omitted and the first flush button 227 may be urged back upwardly by the pressure of the water as it fills up the toilet tank 20.

This action causes the valve 34 to move downwardly over the outlet 38 and seal and close the outlet 38. Since the first knob 286 is sized to be slidably fit into the first cavity 287 of the inner cap 84, the inner cap 84 can guide the movement of the first knob 286 to be aligned over the first flush button 227.

Figure 9:
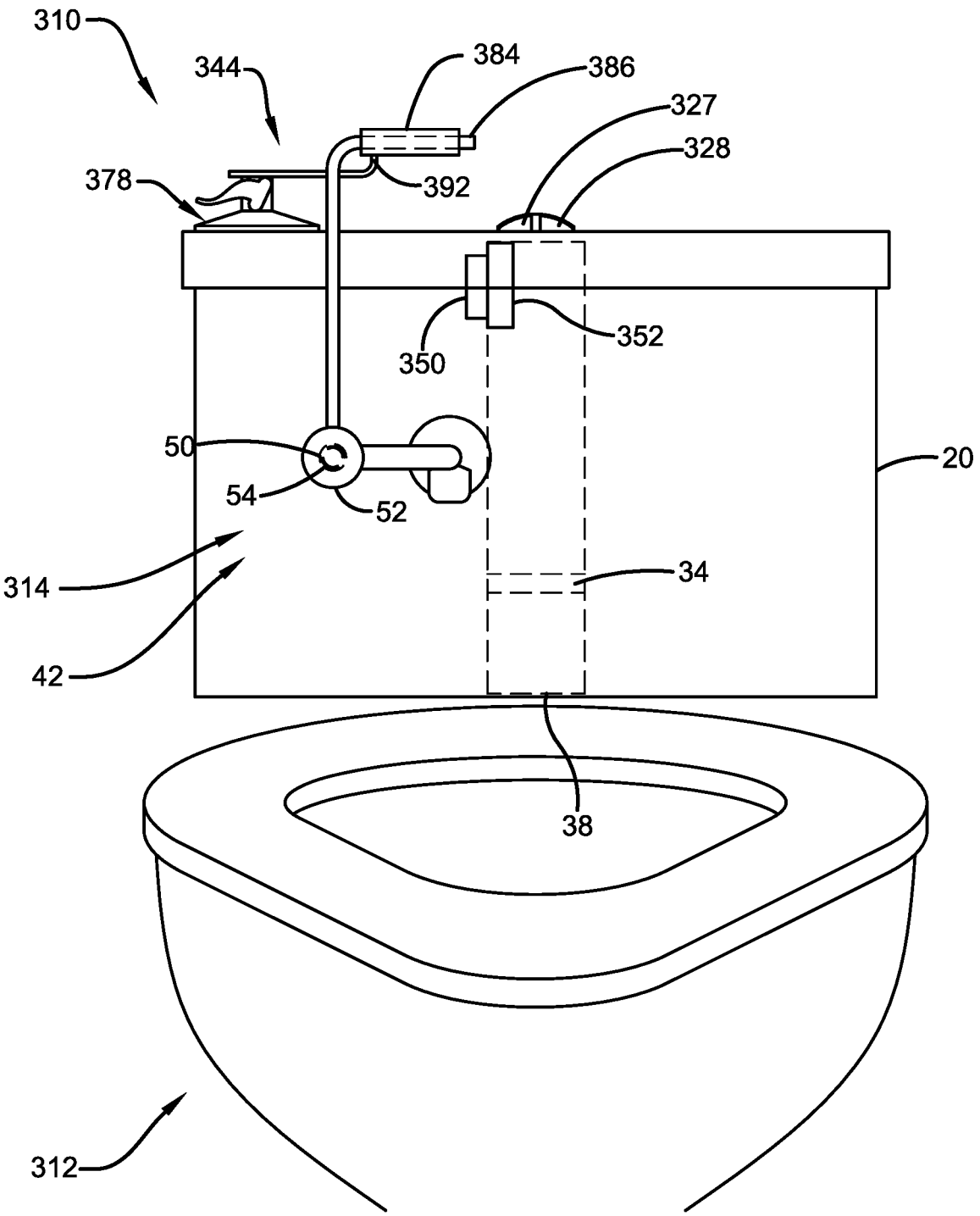
FIG. 9 is a front view of an apparatus in a position that flushes the toilet with portions removed for illustrative purposes according to a third embodiment of the present invention.
Figure 10:
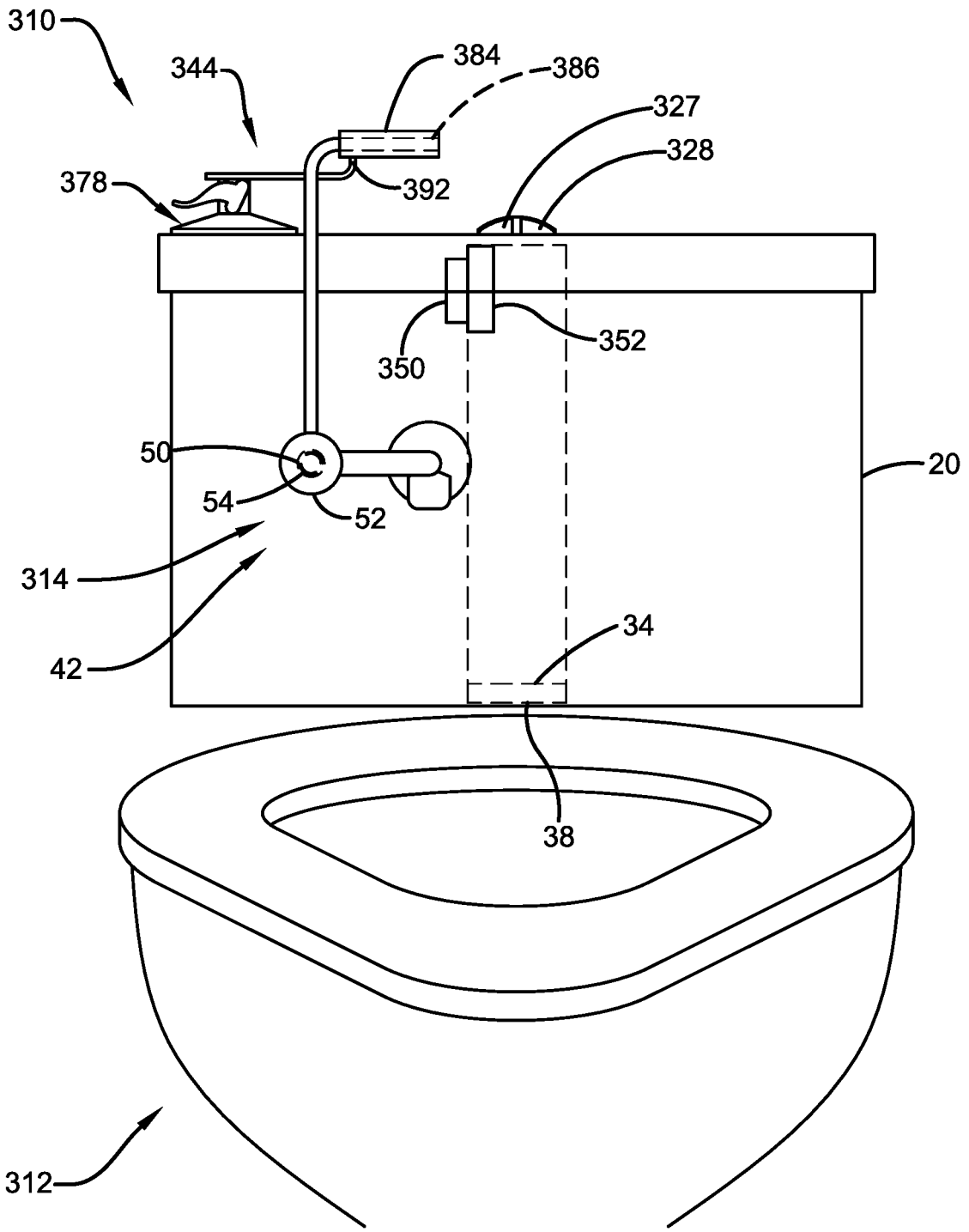
FIG. 10 is a view similar to FIG. 9 but with the apparatus in a position that is not flushing the toilet.
Figure 11:
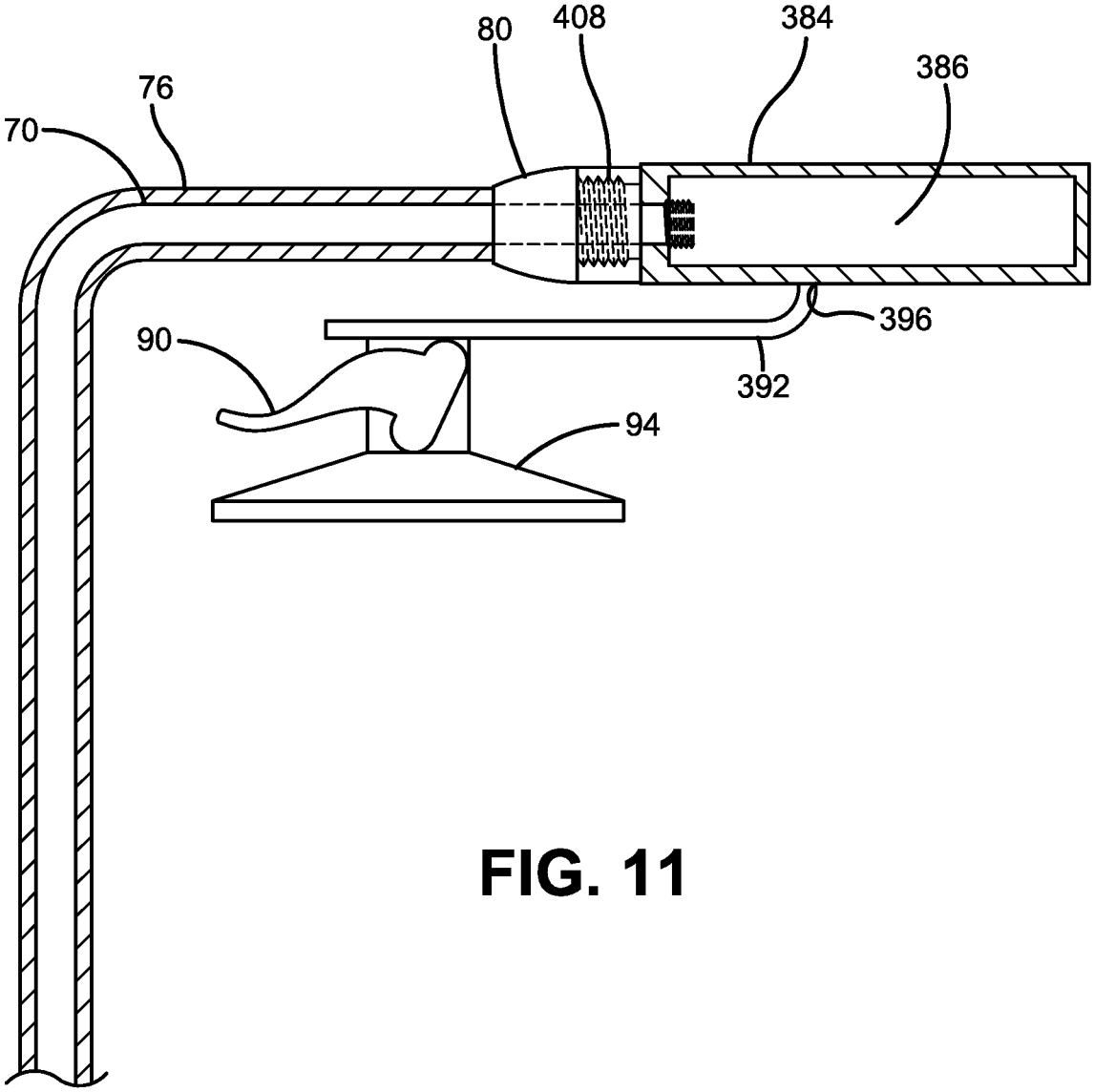
FIG. 11 is a front view of a portion of the apparatus of FIG. 9.

FIGS. 9-11 show a third embodiment of the present invention. The third embodiment is similar to the first embodiment except for the following. Thus, in this third embodiment, elements that are similar in structure and function with the first embodiment will be given the same reference numbers. In this third embodiment, an apparatus is provided 310. The apparatus comprises a toilet 312 and an extender device 314 removably mounted on the toilet 312. The toilet 312 has a motion sensor 350 positioned in the tank 20 or alternatively positioned outside the tank 312. The motion sensor 350 is operatively connected to a motor 352 provided in the tank 20 that is in turn operatively connected to the flush buttons 327, 328. All other elements of this toilet are similar in structure and function with the first embodiment. In this embodiment, the toilet extender 314 includes the same lower assembly 42 as the first embodiment. The toilet extender 314 includes an upper assembly 344. The upper assembly 344 includes an upper suction cup assembly 378, the rotatable nut 80 (FIG. 11), an elongated cap 384, and an elongated knob 386. The upper suction cup assembly 378 includes the flexible upper suction cup 88, the lever 90, and a bracket 392. The bracket 392 has the cupped end 94 that securely receives the upper suction cup 88 and another end 396 that securely receives the elongated cap 384. The elongated cap 384 is fixed to the bracket 392 and remains stationary relative to bracket 392. The elongated cap 384 includes a threaded hollow bolt 408 (FIG. 11). The bolt 408 is threaded on its outer surface.

In this embodiment the end 396 of the bracket 392 is oriented such that the longitudinal axis of the elongated cap 384 is parallel to the attaching surface, which in this embodiment is the top surface of the lid. The line 70 extends through the rotatable nut 80 and the threaded hollow bolt 408 of the elongated cap 384. Similar to the first embodiment, the threaded end 74 of the line is threaded into a knob aperture 114 of the elongated knob 386 to threadily connect the knob 386 to the line 70 at the knob aperture 114. The knob 386 is sized to be slidably fit into the elongated cap 384. The rotatable nut 80 threadily engages the threaded hollow bolt 408 to secure the elongated cap 384 to the line 70. By contrast with the first embodiment, movement of the knob 386 is in the direction parallel to the top surface of the tank as illustrated in FIGS. 9 and 10.

In operation, the extender button 52 is pushed with sufficient force to overcome the biasing forces of the spring 54 to move the line 70 through the handle 50, the male connector 48, the sheath 76, the rotatable nut 80, and the threaded hollow bolt 408 of the elongated cap 384. This movement of the line 70 in turn moves the knob 386 toward the range of the motion sensor 350. When the knob 386 enters the range of the motion sensor 350 as depicted in FIG. 9, the motion sensor 350 activates and sends a control signal to the motor to activate the motor to cause the flush buttons 327, 328 to depress. Depression of the flush buttons 327, 328 causes the toilet 312 to flush in a similar manner to that of the first embodiment. After the pushing force on the extender button 52 is released, the extender push button 52 is urged back upwardly to its initial extended position by the spring 54 until the knob 386 is out of range of the motion sensor. This action deactivates the motion sensor and motor and enables the spring 40 to urge the flush buttons 327, 328 back upwardly to its initial extended position as seen in FIG. 10. Alternatively, the spring 40 may be omitted and the flush buttons 327, 328 may be urged back upwardly by the pressure of the water as it fills up the toilet tank 20. This action in turn moves the valve 34 to move downwardly over the outlet 38 and seal and close the outlet 38.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above-described embodiments, method, and examples, but by all embodiments and methods within the scope and spirit of the invention.

What is claimed is:

1. An extender device for a toilet, wherein the toilet includes a flush button provided on a first surface of a tank for flushing the toilet, wherein the extender device comprises:

an extender button, wherein the extender button is configured to be mounted to a front surface of the tank of the toilet;

a flexible line operatively connected to the extender button;

a member operatively connected to the line, wherein the member is configured to be in operative connection with the flush button, wherein the extender button is configured to be pressed to thereby cause the line to move the member to cause the flush button to depress and flush the toilet.

2. The extender device of claim 1 further comprising a first suction cup and a first bracket, wherein the first suction cup is secure to the first bracket, wherein the first bracket is operatively connected to the extender button to support the extender button, wherein the first suction cup is configured to be removably attach by suction to the front surface of the tank of the toilet.

3. The extender device of claim 2 further comprising a second suction cup and a second bracket, wherein the second suction cup is secure to the second bracket, wherein the second bracket is operatively connected to the member to support the member, wherein the second suction cup is configured to be removably attach by suction to the first surface of the tank of the toilet.

4. The extender device of claim 3 further comprising a first cap, wherein the first cap is operatively connected to the second bracket, wherein the first cap slidably receives the member and is operative to guide the member in alignment over the flush button as the member moves to press the flush button.

5. The extender device of claim 4, further comprising a hollow handle and a coiled spring, wherein the spring extends into the handle, wherein the extender button extends into the handle, wherein the spring is operatively connected to the extender button and biases the extender button in the direction away from the handle such that member is urged in a direction away from the flush button.

6. The extender device of claim 1 further comprising a second suction cup and a second bracket, wherein the second suction cup is secure to the second bracket, wherein the second bracket is operatively connected to the member to support the member, wherein the second suction cup is configured to be removably attach by suction to the front surface of the tank of the toilet.

7. The extender device of claim 6 further comprising a first cap, wherein the first cap is operatively connected to the second bracket, wherein the first cap slidably receives the member and is operative to guide the member in alignment over the flush button as the member moves to press the flush button.

8. The extender device of claim 7 further comprising a second cap, wherein the second cap is rotatably connected to the second bracket, wherein the second cap threadily receives the first cap.

9. The extender device of claim 8 further comprising a sheathing, wherein the sheathing covers said line, wherein said line is movable through the sheathing.

10. The extender device of claim 1, further comprising a hollow handle and a coiled spring, wherein the spring extends into the handle, wherein the extender button extends into the handle, wherein the spring is operatively connected to the extender button and biases the extender button in the direction away from the handle such that member is urged in a direction away from the flush button.

11. An apparatus comprising:

a toilet comprising:

a tank, wherein the tank includes a lid on top of the tank;

a bowl, wherein the bowl is in fluid communication with the tank; and a first flush button provided on a first surface of the tank; and a first extender device comprising:

a first extender button, wherein the first extender button is mounted to a front surface of the tank;

a first flexible line operatively connected to the first extender button;

a first member operatively connected to the first line, wherein the first member is in operative connection with the first flush button, wherein depression of the first extender button causes the first line to move the first member to cause the first flush button to depress and flush the toilet.

12. The apparatus of claim 11 further comprising a second extender device, wherein the tank comprising a second flush button, the second extender device comprising:

a second extender button, wherein the second extender button is mounted to a front surface of the tank;

a second flexible line operatively connected to the second extender button; and a second member operatively connected to the second line, wherein the second member is aligned over the second flush button, wherein depression of the second extender button causes the second line to move the second member to depress the second flush button and flush the toilet.

13. The apparatus of claim 11, wherein the first extender device further comprises a first suction cup and a first bracket, wherein the first suction cup is secure to the first bracket, wherein the first bracket is operatively connected to the first member to support the first member, wherein the first suction cup is configured to be removably attach by suction to the first surface of the tank of the toilet.

14. The apparatus of claim 13, wherein the first extender device further comprises a second suction cup and a second bracket, wherein the second suction cup is secure to the second bracket, wherein the second bracket is operatively connected to the first extender button to support the first extender button, wherein the first suction cup is removably attach by suction to the front surface of the tank of the toilet.

15. The apparatus of claim 13 further comprising a first cap, wherein the first cap is operatively connected to the first bracket, wherein the first cap slidably receives the first member and is operative to guide the member in alignment over the flush button as the member moves to press the flush button.

16. The apparatus of claim 15 further comprising a second extender device, wherein the tank comprising a second flush button, the second extender device comprising:

a second extender button, wherein the second extender button is mounted to a front surface of the tank;

a second flexible line operatively connected to the second extender button; and a second member operatively connected to the second line, wherein the second member is aligned over the second flush button, wherein depression of the second extender button causes the second line to move the second member to depress the second flush button and flush the toilet; and wherein the first cap includes a dividing wall, wherein the dividing wall defines a first cavity and a second cavity, wherein the first member is slidably received in the first cavity, wherein the second member is slidably received in the second cavity.

17. The apparatus of claim 16, wherein the first extender device further comprises a second suction cup and a second bracket, wherein the second suction cup is secure to the second bracket, wherein the second bracket is operatively connected to the first extender button and the second extender button to support the first and second extender buttons, wherein the first suction cup is removably attach by suction to the front surface of the tank of the toilet.

18. The apparatus of claim 11 further comprising a motion sensor, wherein the motion sensor is in operative connection with the first flush button and the first member, wherein depression of the first extender button causes the first line to move the first member to within a predetermined range of the motion sensor and activate the motion sensor to cause the first flush button to depress and flush the toilet.

19. The apparatus of claim 11, further comprising a hollow handle and a coiled spring, wherein the spring extends into the handle, wherein the first extender button extends into the handle, wherein the spring is operatively connected to the first extender button and biases the extender button in the direction away from the handle such that the first member is urged in a direction away from the first flush button.

20. The apparatus of claim 11 further comprising a sheathing, wherein the sheathing covers said line, wherein said line is movable through the sheathing.

* * * * *